United States Patent [19]

Mott

[11] 3,955,521

[45] May 11, 1976

[54] TENSION LEG PLATFORM WITH QUICK RELEASE MECHANISM

[75] Inventor: George E. Mott, Metairie, La.

[73] Assignee: Texaco Inc., New York, N.Y.

[22] Filed: Aug. 11, 1975

[21] Appl. No.: 603,568

[52] U.S. Cl. ..... 114/.5 D; 114/206 R; 114/230

[51] Int. Cl.[2] ..... B63B 35/44; B63B 21/26

[58] Field of Search ..... 114/.5 D, 230, 206 R; 9/8 P; 61/46.5

[56] References Cited

UNITED STATES PATENTS

| | | | |
|---|---|---|---|
| 2,939,291 | 6/1960 | Schurman et al. | 114/.5 D |
| 3,473,505 | 10/1969 | Brown | 114/230 |
| 3,540,396 | 11/1970 | Horton | 114/.5 D |
| 3,799,097 | 3/1974 | Robertson | 114/206 R |

*Primary Examiner*—Trygve M. Blix
*Assistant Examiner*—Gregory W. O'Connor
*Attorney, Agent, or Firm*—T. H. Whaley; C. G. Ries; Robert B. Burns

[57] ABSTRACT

A tension leg marine structure in which a buoyant vessel is maintained in a partially submerged condition by a plurality of hold-down cables. Each cable is fastened to the floating portion of the structure by a quick disconnect coupling which is adapted to be rapidly disengaged, thereby to release a hold-down cable at such time as the latter is relieved of tension. The released part of the unit can then be moved out of the way of floating objects which might otherwise cause it damage.

12 Claims, 5 Drawing Figures

TENSION LEG PLATFORM WITH QUICK RELEASE MECHANISM

BACKGROUND OF THE INVENTION

In the drilling and production of offshore wells in many parts of the world, the tension leg platform appears to be an expeditious structure capable of successfully encountering many of the conditions which hamper the operation of the normal type floating or semisubmersible platform. Operationally, the tension leg type unit is maintained in a partially submerged condition by the combination of ballasting and fastoning by way of a series of essentially vertical cables which attach to anchors firmly embedded at the ocean floor.

Such structures tend to minimize roll, pitch and vertical displacement prompted by weather conditions at the drilling area. They are nonetheless operated at a disadvantage in ice infested areas. This is true since the very nature of their hold-down means discourages rapid removal of the platform when it is determined to be in the path of large floating objects, such as icebergs, ice ridges, and the like.

Since such large, natural floating objects, when urged on by wind and wave conditions, tend to be an irresistible mass, the only feasible solution is to temporarily displace the platform from the path of the mass.

To disconnect the ordinary type offshore platform without losing the mooring lines and anchors necessitates the use of boats and auxiliary equipment and is too time consuming for emergency release in areas subject to ice attack. In the instance of a tension leg unit, the same problem exists. In addition, the anchoring lines are under severe tension and cannot merely be cast off, but must be slackened uniformly, and then disconnected from the floating segment of the platform.

Toward permitting the rapid removal of this type platform when endangered by floating objects, each hold-down cable is provided with a self-detaching coupling which forms a connection between the platform and the anchor. So long as the desired tension in the cable is maintained the platform will be held in its desired working position. However, as cable tension is released, the heavy coupling member will assume such a position as to be readily disengaged or to be self-disengaging, thereby in effect to separate the hold-down cable, thus freeing the floating vessel.

It is therefore an object of the invention to provide a tension leg platform which is particularly capable of quick removal from an offshore working site. A further object is to provide hold-down means for a tension leg platform which is readily actuatable to disconnect the floating platform from floor-positioned anchors. A still further object is to provide a coupling means for a hold-down cable which is adapted to self-disconnect at such time as tension within the cable is released, thereby in effect releasing the platform from its restrained position.

DESCRIPTION OF THE DRAWINGS

Referring to FIG. 1, a tension leg platform of the type contemplated is one that comprises, in essence, a semisubmersible marine vessel 10 having varying buoyancy capabilities. A number of vessels of this type are contemplated for use by the petroleum industry primarily for drilling wells into the ocean floor.

Figure 1:
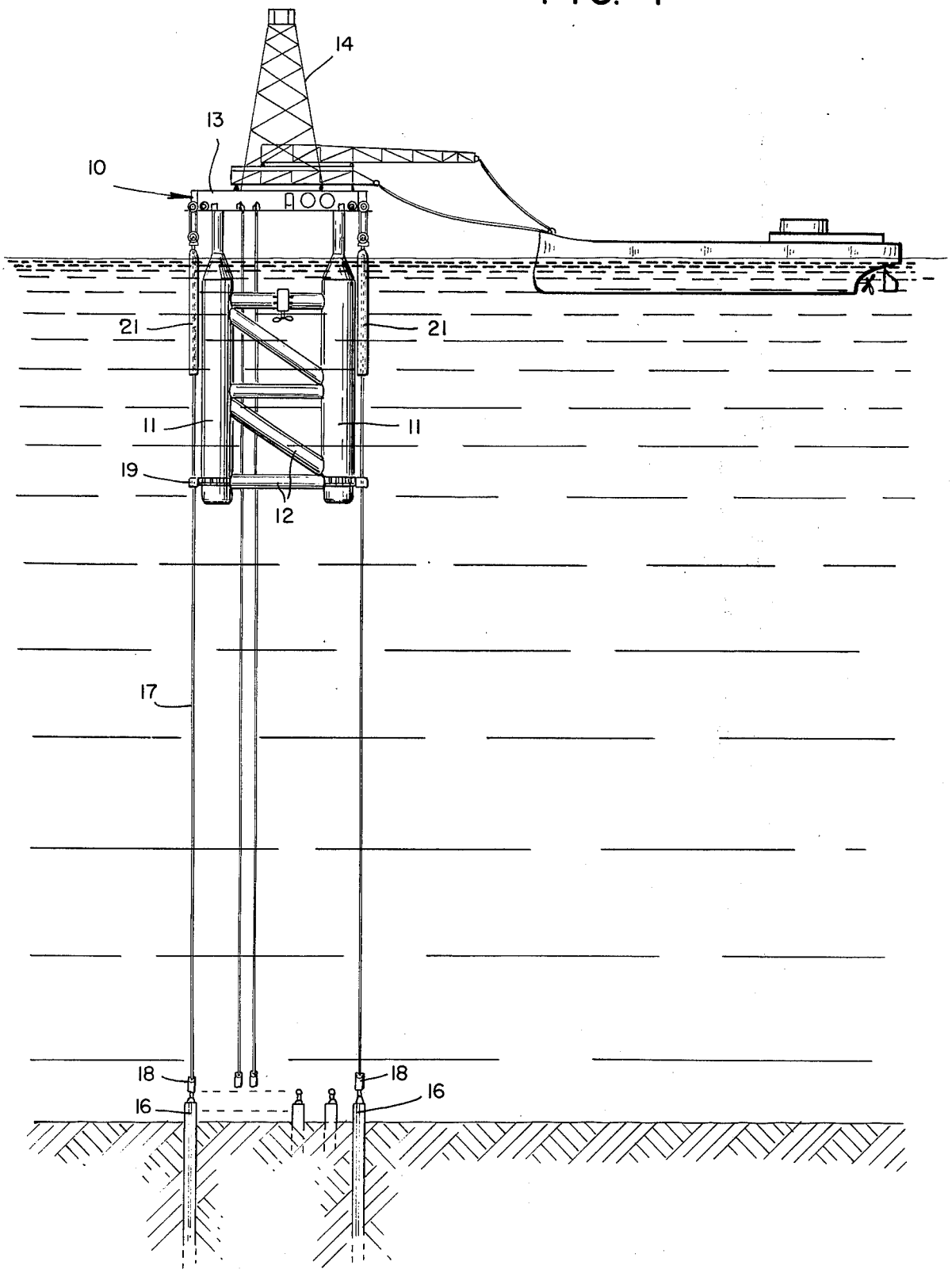
FIG. 1 is an elevation view of a marine offshore platform of the type contemplated.
Figure 2:
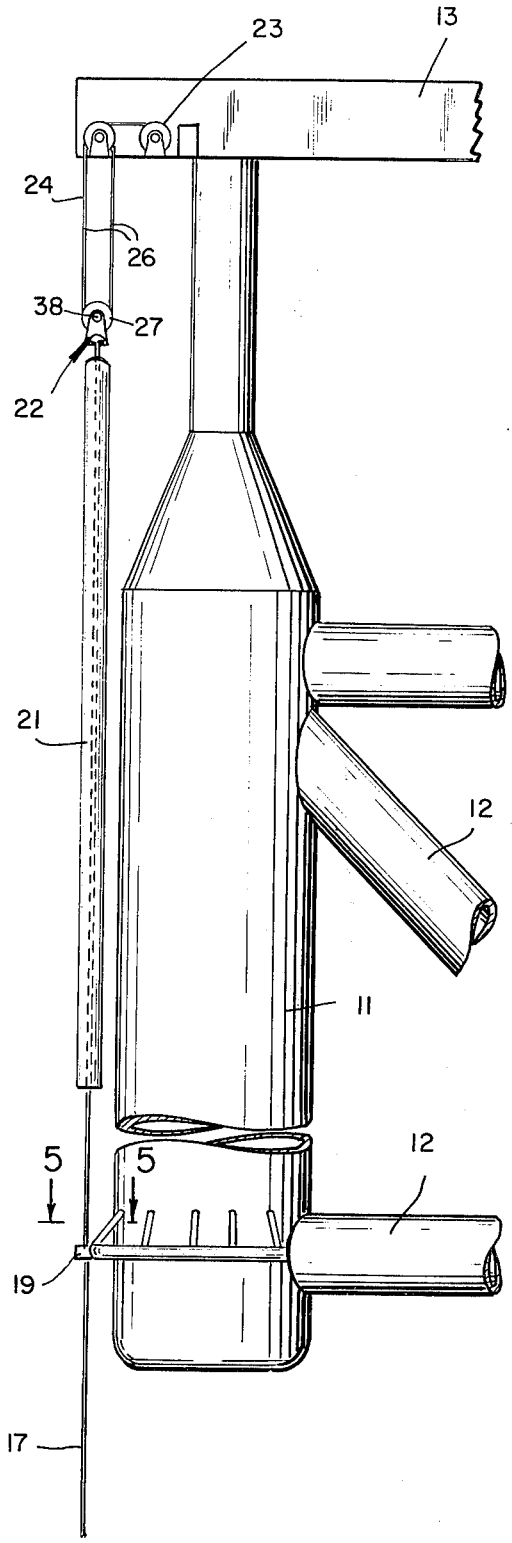
FIG. 2 is a segmentary view of an enlarged scale of a portion of the platform.

In one instance the unit of this type comprises a plurality of elongated, upstanding, adjustable buoyancy tanks or columns 11 which are normally vertically disposed, having a series of connecting members or reinforcing braces 12 therebetween to establish a rigid unit.

The respective columns are supportably connected at the upper end thereof to a working deck 13. The latter accommodates the usual derrick 14, draw works and other equipment ancillary to the drilling of wells and producing crude oil and gas.

Under normal circumstances, without being pulled down to its operating position, the marine vessel 10 would be supported at the water's surface through the buoyancy effect of the respective vertical buoyancy legs 11 and bracing members 12. The former are provided with individual internal means for varying their respective buoyancy capabilities such that the vessel can be adjusted to various depths in accordance with operating conditions.

Further, vessel 10 is normally equipped, by virtue of these buoyant units, to be elevated to a height whereby it can be readily towed to or from an offshore working site as is needed.

Operationally, with the vessel 10 towed to a working location, a series of anchors 16 are set into or upon the ocean floor. Preferably, the anchors form a predetermined pattern in accordance with the distribution of the hold-down positions on the vessel 10. As shown in the present arrangement, each anchor 16, which can be of the gravity type or the piled-in type, is provided with a connector 18 or the equivalent to receive a pull-down cable assembly 17.

The various hold-down or tension cable assemblies 17, which determine the disposition of the vessel 10 in the water, comprise in effect a single, or a series of cables which form the unitary cable assembly 17. Each cable assembly 17 is connected at its lower end to an anchor 16 directly therebeneath and is led upwardly to the vessel 10. At the latter the cable is guided through a fair lead 19 or similar means attached to the lower end of leg 11 for guiding and holding the cable adjacent said leg.

The upper end of the hold-down cable assembly 17 includes a float or buoy 21. The latter can comprise any number of mechanisms adapted to achieve the object of floatability supporting the cable after the latter is released by a coupling 22. Thus, buoy 21 surrounds and maintains the upper end of the hold-down cable 17 at or near the water's surface while permitting icebergs or ice ridges to float by without causing damage to either vessel 10 or to the cable itself.

The upper end of cable 17 is releasably connected, through coupling 22, to a windlass or tensioning system 23 capable of reeling cable 17 in or out as the situation may require. The cable draw-in mechanism 24 is comprised of one, or a series of cables 26 which engage a nulti-unit sheave 27 such that the degree of tension applied to vessel 10 can be varied. The remote end of said cable engages take-up or tensioning mechanism 23.

Figure 3:
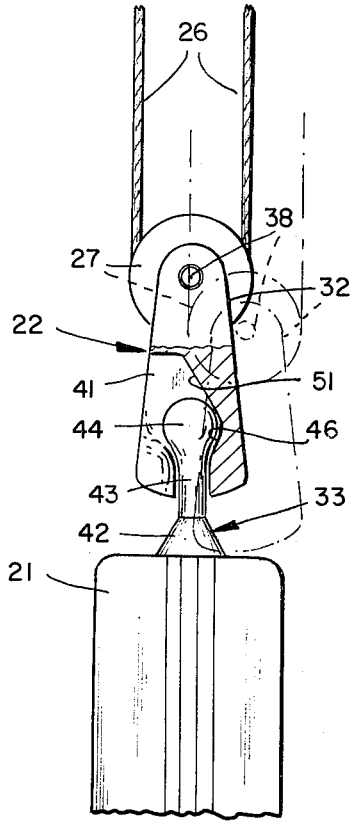
FIG. 3 is a segmentary view of the cable coupling.
Figure 4:
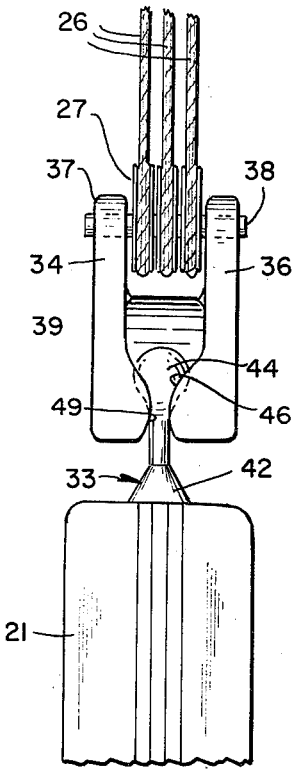
FIG. 4 is a side view of FIG. 3.
Figure 5:
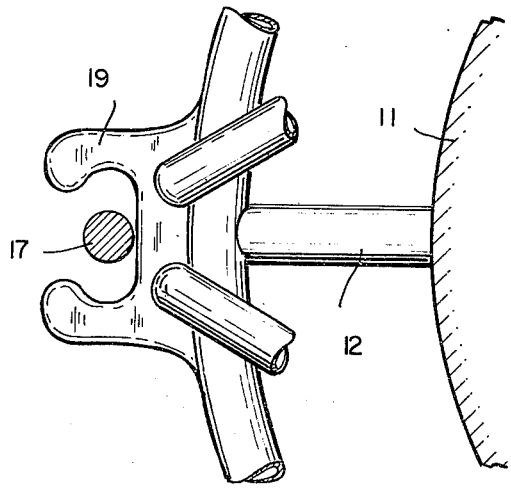
FIG. 5 is a cross-sectional view taken along line 5—5 of FIG. 2.

Referring to FIGS. 3 and 4, each cable assembly 17 is provided with a coupling 22 which is disposed preferably immediately above the supporting buoy 21 and beyond the water's surface. Each coupling 22 comprises mutually interconnected upper and lower members 32 and 33, respectively.

Usually, when in the working condition, a cable assembly 17 is maintained under a substantially constant tension. Thus, the two engaged coupling members 32 and 33 conform to the general line of the cable, i.e., being close to upright column 11. However, said cable line is usually relatively close to a vertical alignment, such that the coupling members are in effect maintained in tension to assume a substantially vertical relationship.

The upper member or segment 32 of coupling 22 comprises a single unit preferably formed of high strength cast iron or steel. Said coupling segment 32 includes oppositely positioned, spaced apart side walls 34 and 36, having means therein to position sheave 27 and support shaft 38 at its upper end. Multi-unit pulley or sheave 27 carried on shaft 38 is rotatable to receive a plurality of cable sections 26 which constitute the adjustable portion of draw-up means 24.

Said coupling member 32 includes a solid end wall 39 which interconnects the respective side walls 34 and 36. End wall 39 commences at a point toward the coupling lower end and terminates adjacent the underside of the cable carrying sheave 27 to permit freedom of rotation of the latter.

Between the respective side walls 34 and 36 of coupling member 32, an internal cavity 41 is defined having walls contoured sufficiently to receive a corresponding member of lower coupling segment 33.

Said lower coupling segment 33 includes primarily a relatively wide base 42 which prevents buoy 21 from riding up on couplings 32 and 33. A shank 43 extends upwardly in a generally vertical direction from base 40. Shank 43 is of uniform diameter and yet of sufficient size to sustain the heavy load that is normally applied to hold-down cable 17. The upper end of shank 43 is provided with a bulbous knob 44 having a generally outwardly expanding, convex undersection which terminates at a maximum midsection. The knob is thereafter formed into a generally oval-shaped upper cap.

Operationally, with the upper and lower coupling members 32 and 33 engaged, the bulbous knob 44 will reside within the confines of cavity 41. Further, said knob 44 engages a circular seat 46 formed by the inwardly contracted lower end of member 33.

Cavity 41 formed within upper coupling segment 32 is so contoured to slidably accommodate the bulbous knob 44 therein. Further, said cavity 41 is provided with an elongated lateral inlet having an expanded upper portion 48 and a relatively constricted or narrow section 49. Thus, knob 44, and the relatively narrow shank 43, can be slidably assembled into cavity 41 by a combined downward and sideward movement of the lower coupling segment 33.

Toward facilitating the rapid disengagement of the coupled parts 32 and 33, cavity 41 is provided with an outwardly sloping wall along surface 51. This section of said cavity can be formed or contoured directly into the coupling segment, or it can take the form of a detachable shoe which is fastened into place within a suitable recess provided therefor.

The respective upper and lower coupling members, as noted, are brought into engagement by causing knob 44 to enter cavity inlet 48–49 by a combined sideways, downward movement. This will permit shank 43 to pass through the constricted opening segment 49. At this time the cap portion of knob 44 will slidably engage cavity guide surface 51 and thus be urged downwardly toward its resting position against seat 46.

As tension is applied to upper coupling member 32 by the draw-up mechanism 24, the partially circular seating surface 46 will rise to firmly abut the corresponding annular seat on knob 44. The two coupling members will thereafter remain in positive engagement so long as tension is maintained on cable 17.

To effect a rapid disconnect of vessel 10 from anchors 16 prior to leaving a working position, tension on the various hold-down cables 17 is relieved. This can be achieved either through adjustment of the cable tension system 23 or alternately by lowering vessel 10 by way of its ballast system.

As tension in cable 17 is eased, upper coupling member 32 will descend onto member 33, which is in turn supported in the water by buoy 21. As a result of vessel 10 rising, cable 17 will slide downwardly through fair lead 19 until float 21 approaches the latter. Further lowering will cause the float, and consequently the cable, to be forced from the fair lead, thereby to clear the vessel.

As member 32 slides downwardly, the upper surface of knob 44 will slidably engage guide wall 51, thereby laterally shifting the relative positions of 32 and 33.

Further, lowering of 32 will then permit knob 44 to be guided upwardly through the cavity inlet, thus to effect complete separation of the respective coupling members.

In such condition vessel 10 is freed of any restraint, to be towed away or to move under its own propulsion system. The respective pull-down cable 17 will then remain at or near the water's surface by virtue of buoy 21 and can readily be retained at a later time when vessel 10 can safely return to its position. Thereafter, the coupling 22 on each hold-down cable can be reconnected, thus allowing tension to be applied to again lower vessel 10 to its desired depth in the water.

It is understood that other modifications and variations of the invention as hereinbefore set forth may be made without departing from the spirit and scope thereof, and only such limitations should be imposed as are indicated in the appended claims.

I claim:

1. Mooring system for an offshore tension leg structure including:

a semisubmersible vessel (10) having at least one controlled buoyancy member (11), and having means in the latter for altering said vessel's buoyancy whereby to regulate the vessel's floating disposition in a body of water;

elongated hold-down anchoring means (17) attachable to said vessel (10) for drawing the latter into said water against its upward buoyant force, when tension is applied to said hold-down anchoring means;

tensioning means (24) on said vessel positioned to engage said hold-down anchoring means (17) and being operable to vary the tension on the latter to affect lowering of the vessel; and self-disengaging coupling means (22) detachably connecting said elongated hold-down anchoring means (17) with said tensioning means (24) and being operable to automatically become disengaged when tension on said hold-down anchoring means (17) is relieved.

2. In an apparatus as defined in claim 1 wherein said elongated hold-down anchoring means includes: a buoyancy means connected thereto at a point below and adjacent to said self-disengaging coupling means, whereby to maintain said coupling means at the water's surface when the latter is disengaged from said vessel.

3. In an apparatus as defined in claim 1 wherein said elongated hold-down anchoring means includes:

an anchor positioned at the floor of said body of water; and a flexible connector means having the lower end thereof connected to said anchor and having said buoyancy means at the flexible connector means' upper end.

4. In an apparatus as defined in claim 3 wherein said flexible connector means includes an elongated cable.

5. In an apparatus as defined in claim 2 wherein said buoyancy means includes: an elongated, fixed buoyancy member connected to said hold-down anchoring means.

6. In an apparatus as defined in claim 2 wherein said buoyancy member includes: an elongated controlled buoyancy buoy connected to and surrounding the upper portion of said hold-down anchoring means.

7. In an apparatus as defined in claim 1 wherein said tensioning means includes: an elongated cable, and a wind-up mechanism connected thereto for adjusting the length of said cable.

8. In an apparatus as defined in claim 1 wherein said tensioning means depends downwardly from said vessel terminating at a point above the water's surface.

9. In an apparatus as defined in claim 1 wherein said self-disengaging coupling means includes: a pair of cooperatively positioned members, cavity means formed in one of said members, and having the other of said members detachably received in said cavity means.

10. In an apparatus as defined in claim 1 wherein said self-disengaging coupling means includes: an upper member having a cavity therein and depending from said tensioning means in a vertical dispostion, and an elongated member extending upwardly from said hold-down anchoring means and being operably received in said cavity means to be firmly there held when said coupling means is subjected to tension.

11. In an apparatus as defined in claim 10 wherein said coupling means includes: a lateral opening formed in said upper member providing access to said cavity means.

12. In an apparatus as defined in claim 10 wherein said cavity means formed in said upper member includes: a guiding wall disposed in sloping relationship with said upper member to urge the same in a lateral direction when said member is lowered onto said lower coupling member.

* * * * *